US006951239B1

(12) United States Patent
Snyder et al.

(10) Patent No.: US 6,951,239 B1
(45) Date of Patent: Oct. 4, 2005

(54) METHODS FOR MANUFACTURING INVESTMENT CASTING SHELLS

(75) Inventors: Jacob A. Snyder, Southington, CT (US); James T. Beals, West Hartford, CT (US); Joshua E. Persky, Manchester, CT (US); Carl R. Verner, Windsor, CT (US); Lea D. Kennard, Manchester, CT (US); Dawn D. Mandich, Monrovia, MD (US); Stephen D. Murray, Marlborough, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 10/825,396

(22) Filed: Apr. 15, 2004

(51) Int. Cl.[7] ..... B22C 9/04

(52) U.S. Cl. ..... 164/516; 164/35

(58) Field of Search ..... 164/35, 516–519

(56) References Cited

U.S. PATENT DOCUMENTS

| | | | | |
|---|---|---|---|---|
| 6,209,621 | B1 * | 4/2001 | Treacy | 164/516 |
| 6,637,500 | B2 | 10/2003 | Shah et al. | |
| 2002/0104639 | A1 * | 8/2002 | Kroes | 164/319 |

* cited by examiner

*Primary Examiner*—Kuang Y. Lin
(74) *Attorney, Agent, or Firm*—Bachman & LaPointe, P.C.

(57) ABSTRACT

An at least two step heating process is used to strengthen the shell of an investment casting mold including a refractory metal core. The first stage may occur under otherwise oxidizing conditions at a low enough temperature to avoid substantial core oxidation. The second stage may occur under essentially non-oxidizing conditions at a higher temperature.

25 Claims, 2 Drawing Sheets

METHODS FOR MANUFACTURING INVESTMENT CASTING SHELLS

BACKGROUND OF THE INVENTION (1) Field of the Invention

The invention relates to investment casting. More particularly, the invention relates to investment casting using molds having oxidizable cores.

(2) Description of the Related Art

Investment casting is a commonly used technique for forming metallic components having complex geometries, especially hollow components, and is used in the fabrication of superalloy gas turbine engine components.

Gas turbine engines are widely used in applications including aircraft propulsion, electric power generation, ship propulsion, and pumps. In gas turbine engine applications, efficiency is a prime objective.

Improved gas turbine engine efficiency can be obtained by operating at higher temperatures, however current operating temperatures in the turbine section exceed the melting points of the superalloy materials used in turbine components. Consequently, it is a general practice to provide air cooling. Cooling is typically provided by flowing relatively cool air from the compressor section of the engine through passages in the turbine components to be cooled. Such cooling comes with an associated cost in engine efficiency. Consequently, there is a strong desire to provide enhanced specific cooling, maximizing the amount of cooling benefit obtained from a given amount of cooling air. This may be obtained by the use of fine, precisely located, cooling passageway sections.

A well developed field exists regarding the investment casting of internally-cooled turbine engine parts such as blades and vanes. In an exemplary process, a mold is prepared having one or more mold cavities, each having a shape generally corresponding to the part to be cast. An exemplary process for preparing the mold involves the use of one or more wax patterns of the part. The patterns are formed by molding wax over ceramic cores generally corresponding to positives of the cooling passages within the parts. In a shelling process, a ceramic shell is formed around one or more such patterns in well known fashion. The wax may be removed such as by melting in an autoclave. The shell may be fired to strengthen the shell. This leaves a mold comprising the shell having one or more part-defining compartments which, in turn, contain the ceramic core(s) defining the cooling passages. Molten alloy may then be introduced to the mold to cast the part(s). Upon cooling and solidifying of the alloy, the shell and core may be mechanically and/or chemically removed from the molded part(s). The part(s) can then be machined and/or treated in one or more stages.

The ceramic cores themselves may be formed by molding a mixture of ceramic powder and binder material by injecting the mixture into hardened metal dies. After removal from the dies, the green cores are thermally post-processed to remove the binder and fired to sinter the ceramic powder together. The trend toward finer cooling features has taxed core manufacturing techniques. The fine features may be difficult to manufacture and/or, once manufactured, may prove fragile. Commonly-assigned co-pending U.S. Pat. No. 6,637,500 of Shah et al. discloses various examples of a ceramic and refractory metal core combination. Various refractory metals, however, tend to oxidize at high temperatures in the vicinity of the temperatures used to fire the shell. Thus, the shell firing may degrade the refractory metal cores and, thereby produce potentially unsatisfactory part internal features. Accordingly, there remains room for further improvement in such cores and their manufacturing techniques.

SUMMARY OF THE INVENTION

One aspect of the invention involves a method for forming an investment casting mold. A shell is formed over a pattern comprising a hydrocarbon-based body with a refractory metal-based core at least partially embedded in the body. The body is then substantially removed from the shell. The shell is strengthened by heating in a first atmosphere of a first composition. The shell is further strengthened by heating in a vacuum or second atmosphere of a second composition, different than the first composition.

In various implementations, the heating of the further strengthening step may be a preheating prior to an introduction of molten metal to the mold. The first composition may be more oxidative than the second composition. The method may be used to fabricate a gas turbine engine airfoil element such as a blade or vane. The first composition may consist, in major part (e.g., by volume), of air. The second composition may consist, in major part, of one or more inert gases. The first composition may have an oxygen partial pressure of at least 15 kPa. The second composition may have an oxygen partial pressure of no more than 10kPa. The strengthening may be effective to provide the shell with a first modulus of rupture (MOR) strength of 65–80% of a maximum MOR strength. The further strengthening may be effective to provide the shell with a second MOR strength of at least 85% of said maximum MOR strength. After the substantial removal of the body, the shell may have a preliminary MOR strength of no more than 50% of said maximum MOR strength.

Another aspect of the invention involves a method for investment casting. Such a casting mold may be formed. Molten metal may be introduced to the mold. The molten metal may be permitted to solidify. The mold may be destructively removed. In various implementations, the temperature of the shell does not fall below a threshold (such as 1200 F) between the further strengthening and the introduction of the molten metal.

Another aspect of the invention involves a method for forming an investment casting mold. One or more coating layers are applied to a sacrificial pattern having a wax first portion and a second portion comprising refractory metal. A steam dewaxing may remove a major portion of the pattern first portion and leave the second portion within a shell formed by the coating layers. There may be a first heating of the shell to harden the shell and remove residues or byproducts of the wax. This first heating may be effective to provide the shell with a first modulus of rupture (MOR) strength no more than 85% of a maximum MOR strength. A second heating of the shell may strengthen the shell to a second MOR strength.

In various implementations, the first heating may be in an oxidizing atmosphere and the second heating may be in vacuum or an inert atmosphere. The second heating may be a preheating prior to molten metal introduction. The first MOR strength may be 65–80% of the maximum MOR strength. The second heating may be effective so that the second MOR strength is at least 85% of the maximum MOR strength. The first heating may have a peak temperature between 800 F and 1100 F The second heating may have a peak temperature in excess of 1500 F. The first heating may have a temperature between 800 F and 1100 F for at least 2.0 hours. The second heating may have a temperature in excess of 1500 F for at least 1.0 hour. The second portion may comprise the refractory metal core, a coating on the refractory metal core, and a ceramic core secured to the refractory metal core prior to the applying.

Another aspect of the invention involves a method for forming an investment casting mold. One or more coating layers are applied to a sacrificial pattern having a first portion for forming a mold void and a second portion for forming a portion of the mold. In a first step, a major portion of the pattern first portion is removed leaving the second portion within a shell formed by the coating layers. In a second step, the shell is initially hardened effective to provide the shell with a first modulus of rupture (MOR) strength no more than 85% of a maximum MOR strength. In a third step, the shell is further hardened without substantial degradation of the pattern second portion.

In various implementations, the method may be used to fabricate a gas turbine engine component. The second step may be essentially performed under an oxygen partial pressure of at least 20 kPa. The third step may be essentially performed under an oxygen partial pressure of no more than 5 kPa.

Another aspect of the invention involves a system for forming an investment casting mold. Means are provided for forming a shell over a pattern. The pattern comprises a hydrocarbon-based body with a refractory metal-based core at least partially embedded in the body. Means are provided for substantially removing the body from the shell. Means are provided for strengthening the shell by heating in a first atmosphere of a first composition. Means are provided for further strengthening of the shell by heating in a vacuum or a second atmosphere of a second composition, different than the first composition.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
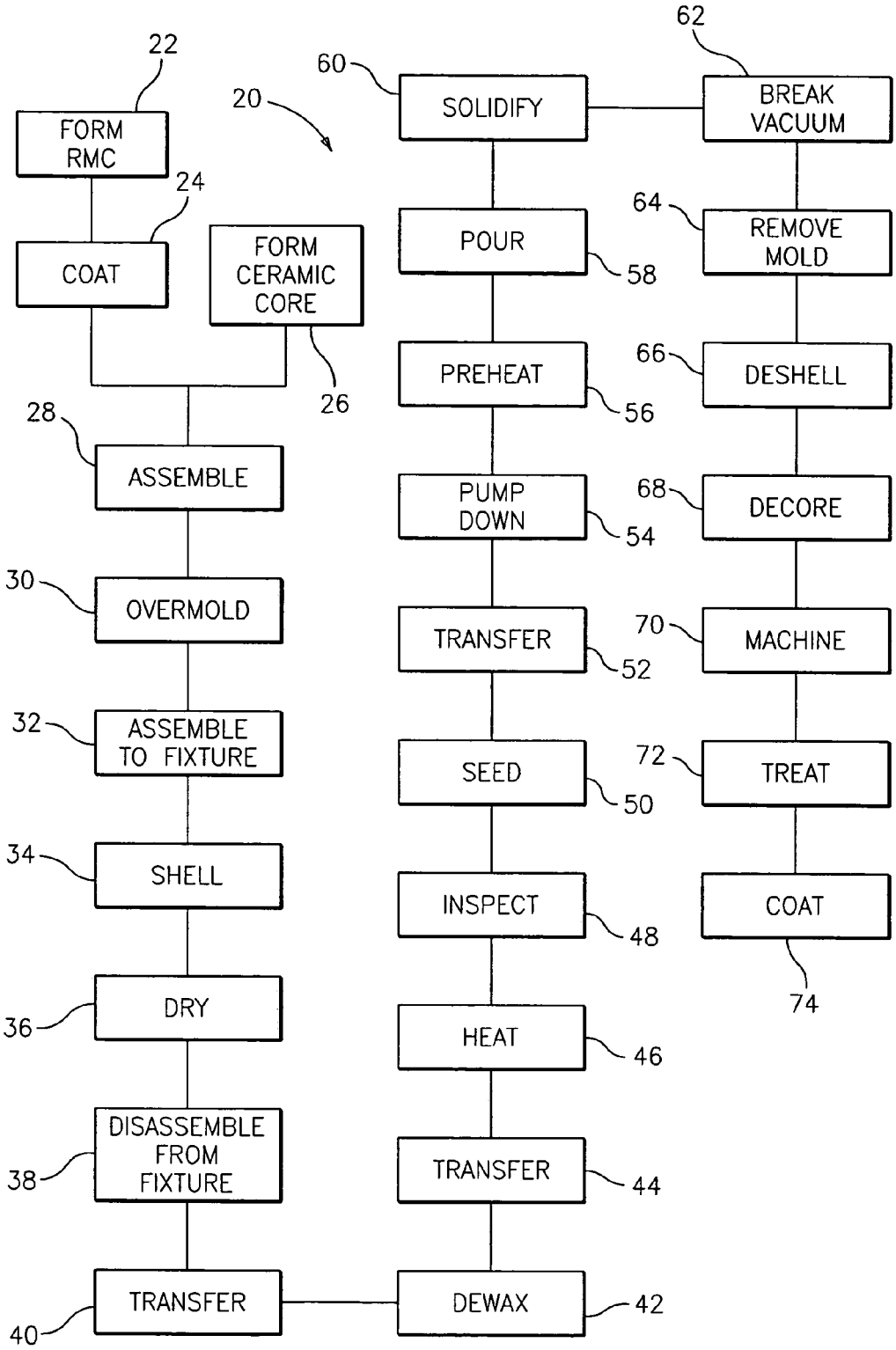
FIG. 1 is a flowchart of a first mold manufacturing process according to principles of the invention.

FIG. 1 shows an exemplary method 20 for forming an investment casting mold. One or more metallic core elements are formed 22 (e.g., of refractory metals such as molybdenum and niobium by stamping or otherwise cutting from sheet metal) and coated 24. Suitable coating materials include silica, alumina, zirconia, chromia, mullite and hafnia. Preferably, the coefficient of thermal expansion (CTE) of the refractory metal and the coating are similar. Coatings may be applied by any appropriate technique (e.g., CVD, PVD, electrophoresis, and sol gel techniques). Individual layers may typically be 0.1 to 1 mil thick. Metallic layers of Pt, other noble metals, Cr, and Al may be applied to the metallic core elements for oxidation protection, in combination with a ceramic coating for protection from molten metal erosion and dissolution.

One or more ceramic cores are also formed 26 (e.g., of silica in a molding and firing process). One or more of the coated metallic core elements (hereafter refractory metal cores (RMCs)) are assembled 28 to one or more of the ceramic cores. The core assembly is then overmolded 30 with an easily sacrificed material such as a natural or synthetic wax (e.g., via placing the assembly in a mold and molding the wax around it). There may be multiple such assemblies involved in a given mold.

The overmolded core assembly (or group of assemblies) forms a casting pattern with an exterior shape largely corresponding to the exterior shape of the part to be cast. The pattern may then be assembled 32 to a shelling fixture (e.g., via wax welding between end plates of the fixture). The pattern may then be shelled 34 (e.g., via one or more stages of slurry dipping, slurry spraying, or the like). After the shell is built up, it may be dried 36. The drying provides the shell with at least sufficient strength or other physical integrity properties to permit subsequent processing. For example, the shell containing the invested core assembly may be disassembled 38 fully or partially from the shelling fixture and then transferred 40 to a dewaxer (e.g., a steam autoclave). In the dewaxer, a steam dewax process 42 removes a major portion of the wax leaving the core assembly secured within the shell. The shell and core assembly will largely form the ultimate mold. However, the dewax process typically leaves a wax or byproduct hydrocarbon residue on the shell interior and core assembly.

After the dewax, the shell is transferred 44 to an atmospheric furnace (e.g., containing air or other oxidizing atmosphere) in which it is heated 46 to a first peak temperature and for a first time duration effective to prestrengthen the shell. The heating 46 may also remove any remaining wax residue (e.g., by vaporization) and/or converting hydrocarbon residue to carbon. Oxygen in the atmosphere reacts with the carbon to form carbon dioxide. Removal of the carbon is advantageous to avoid the carbon clogging the vacuum pumps used in subsequent stages of operation. This burning off of the carbon may be generally coincident with oxidation of the shell associated with the advantageous prestrengthening of the shell. An exemplary prestrengthening provides the shell with a fraction of its ultimate (e.g., the maximum fully-fired) modulus of rupture (MOR) strength (e.g., 50–90%, more narrowly 60–85% or 65–80%). For typical shell materials, industry practice generally associates firing at a temperature of at least 1500 F for a duration of at least one hour as essentially fully firing the shell to achieve essentially maximum MOR strength. In common practice the shell is maintained at least generally isothermal for at least this period. This may represent an increase from well below 50% of ultimate MOR strength in the relatively green state immediately post-dewax. The pre-harden temperature is, advantageously, sufficiently low, in view of the oxidizing nature of the atmosphere in the atmospheric furnace to avoid substantial oxidation of the metallic core element(s). Despite the presence of the protective coating, oxidation is still a substantial potential problem due to the presence of microcracks and porosity in the coating. Oxidation can produce coating delamination or other damage and surface irregularities on the metallic core. Coating damage may allow vaporization of the metallic core elements at the high subsequent casting temperatures and/or reactions between the casting alloy and the metallic core elements. Surface irregularities caused by the oxidation may, in turn form imperfections in the associated interior surfaces of the cast part—a particular problem where fine features are being formed. The exemplary peak preharden temperature is less than 1150 F (e.g., 800–1100 F) for a preharden time of 2–4 hours. An exemplary preharden temperature and time is about 1000 F for about 3.5 hours.

After the prehardening, the mold may be removed from the atmospheric furnace, allowed to cool, and inspected 48. The mold may be seeded 50 by placing a metallic seed in the mold to establish the ultimate crystal structure of a directionally solidified (DS) casting or a single-crystal (SX) casting. Nevertheless the present teachings may be applied to other DS and SX casting techniques (e.g., wherein the shell geometry defines a grain selector) or to casting of other microstructures. Alternatively, the mold may have The mold may be transferred 52 to a casting furnace (e.g., placed atop a chill plate in the furnace). The casting furnace may be pumped down to vacuum 54 or charged with a non-oxidizing atmosphere (e.g., inert gas) to prevent oxidation of the casting alloy. The casting furnace is heated 56 to preheat the mold. This preheating serves two purposes: to further harden and strengthen the shell (e.g., by at least 5% more of ultimate MOR strength); and to preheat the shell for the introduction of molten alloy to prevent thermal shock and premature solidification of the alloy. Accordingly, the preheat temperature and duration are advantageously sufficient to substantially further harden the shell above its prehardened condition. This may involve sintering of the ceramic particles within the shell. Advantageous MOR is in excess of 85%, and more particularly, in excess of 90 or 95% of ultimate MOR. This may be achieved with a preheat temperature of at least 1200 F, more particularly, at least 1400 F with an exemplary preheat temperature of about 1600 F. Exemplary preheat times are approximately one hour (e.g., 0.25–4.0 hours, more narrowly, 0.75–2.0 hours).

After preheating and while still under vacuum conditions, the molten alloy is poured 58 into the mold and the mold is allowed to cool to solidify 60 the alloy (e.g., after withdrawal from the furnace hot zone). After solidification, the vacuum may be broken 62 and the chilled mold removed 64 from the casting furnace. The shell may be removed in a deshelling process 66 (e.g., mechanical breaking of the shell) and the core assembly removed in a decoring process 68 (e.g., a chemical process) to leave a cast article (e.g,. a metallic precursor of the ultimate part). The cast article may be machined 70, chemically and/or thermally treated 72 and coated 74 to form the ultimate part.

Figure 2:
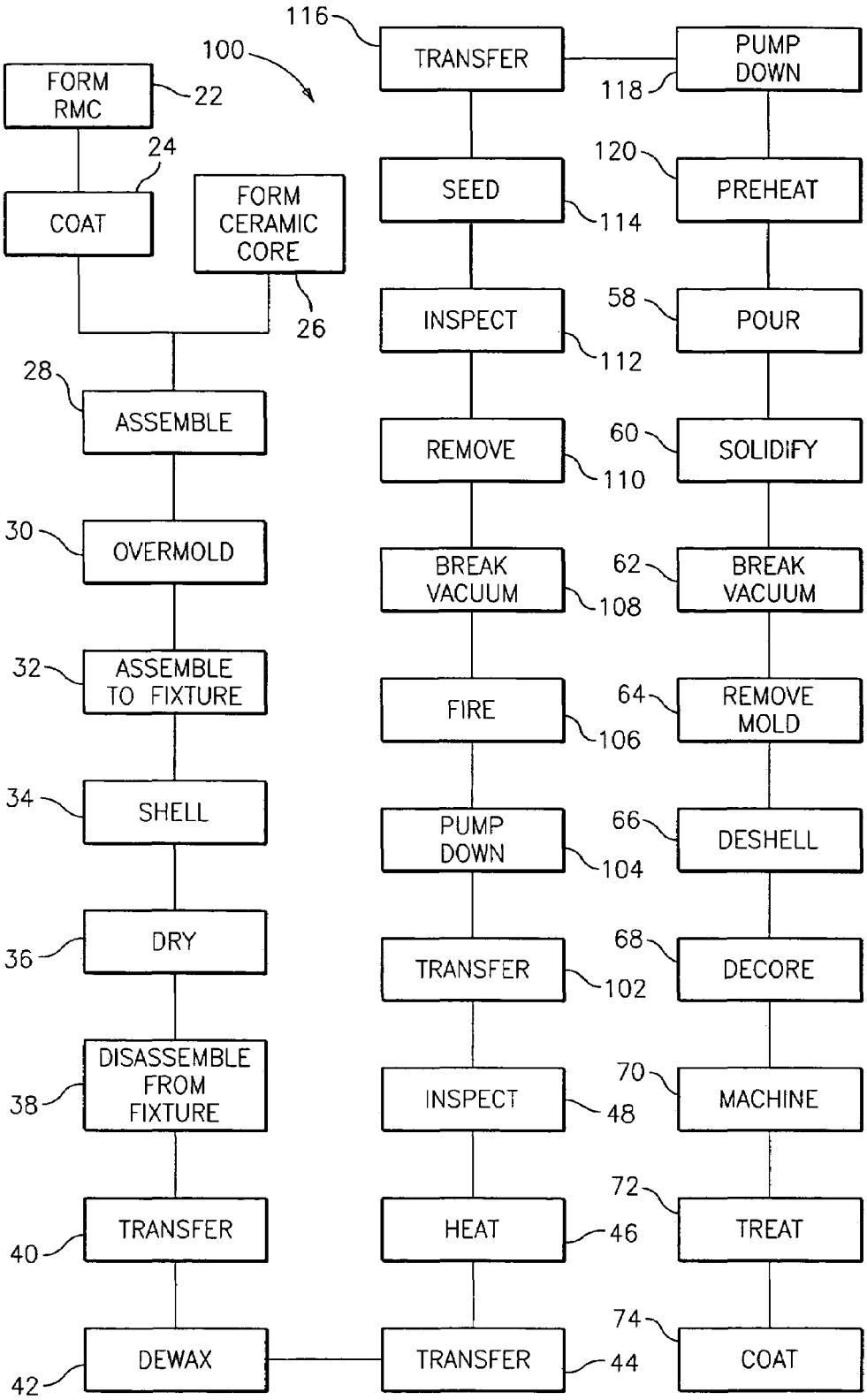
FIG. 2 is a flowchart of a second mold manufacturing process according to principles of the invention.

FIG. 2 shows an alternate version 100 of the exemplary process wherein like steps are shown with like numerals. The alternate process, however, separates the firing from the preheating. Thus, after the inspection 48, the prehardened mold is transferred 102 to a nonatmospheric furnace which may be separate from the casting furnace in which casting subsequently occurs. After transfer, the nonatmospheric furnace may be pumped down 104 to vacuum (and/or charged with an inert atmosphere such as a noble gas or mixture thereof). After the pump down, the mold may be fired 106 at a temperature and duration similar to the preheat 56. After firing, the vacuum may be broken 108 (or inert atmosphere otherwise vented) and the mold removed 110. After the removal, there may be a subsequent inspection 112, temporary storage, additional processing, and the like. Thereafter, the mold may be seeded 114 and transferred 116 to the casting furnace. A pump down 118 may be similar to the pump down 54. A preheat 120 may be similar to the preheat 56 or more abrupt as the firing function will, at least largely, already have taken place.

One or more embodiments of the present invention have been described. Nevertheless, it will be understood that various modifications may be made without departing from the spirit and scope of the invention. For example, the principles may be implemented as modifications of existing or yet-developed processes in which cases those processes would influence or dictate parameters of the implementation. Accordingly, other embodiments are within the scope of the following claims.

What is claimed is:

1. A method for forming an investment casting mold comprising:

forming a shell over a pattern comprising a hydrocarbon-based body with a refractory metal-based core at least partially embedded in the body;

substantially removing the body from the shell;

strengthening the shell by heating in a first atmosphere of a first composition to a modulus of rupture (MOR) strength no more than 85% of a maximum MOR strength; and further strengthening the shell by heating in a vacuum or second atmosphere of a second composition, different than the first composition.

2. The method of claim 1 wherein:

the heating of the strengthening is substantially at 800–1100 F; and the heating of the further strengthening is substantially at 1400–1600 F.

3. The method of claim 1 wherein:

the heating of the further strengthening is a preheating prior to an introduction of molten metal to the mold.

4. The method of claim 1 wherein:

said first composition is more oxidative than said second composition.

5. The method of claim 1 used to fabricate a gas turbine engine turbine airfoil element.

6. The method of claim 1 wherein:

the first composition consists in major part of air.

7. The method of claim 6 wherein:

the second composition consists in major part of one or more inert gasses.

8. The method of claim 1 wherein:

the first composition has an oxygen partial pressure of at least fifteen kPa.

9. The method of claim 8 wherein:

the second composition has an oxygen partial pressure of no more than ten kPa.

10. The method of claim 1 further comprising:

fully embedding the refractory metal-based core in the hydrocarbon-based body.

11. The method of claim 1 wherein:

the strengthening is effective to provide the shell with a first modulus of rupture (MOR) strength of 65–80% of a maximum MOR strength; and the further strengthening is effective to provide the shell with a second MOR strength of at least 85% of said maximum MOR strength.

12. The method of claim 11 wherein:

after said substantially removing, the shell has a preliminary MOR strength of no more than 50% of said maximum MOR strength.

13. A method for investment casting comprising:

forming an investment casting mold as in claim 1;

introducing molten metal to the mold;

permitting the molten metal to solidify; and destructively removing the mold.

14. The method of claim 13 wherein:

a temperature of the shell does not fall below 1200 F between the further strengthening and the introducing.

15. A method for forming an investment casting mold comprising:

applying one or more coating layers to a sacrificial pattern having a wax first portion and a second portion comprising a refractory metal core;

steam dewaxing of the coated pattern so as to remove a major portion of the pattern first portion and leaving the second portion within a shell formed by the coating layers;

first heating the shell to harden the shell and remove residues or byproducts of the wax, the first heating being effective to provide the shell with a first modulus of rupture (MOR) strength no more than 85% of a maximum MOR strength; and second heating of the shell to strengthen the shell to a second MOR strength.

16. The method of claim 15 wherein:

the first heating is in an oxidizing atmosphere; and the second heating is in vacuum or an inert atmosphere.

17. The method of claim 15 wherein:

the second heating is a preheating prior to molten metal introduction.

18. The method of claim 15 wherein:

the first MOR strength is 65–80% of said maximum MOR strength; and the second heating is effective so that the second MOR strength is at least 85% of said maximum MOR strength.

19. The method of claim 15 wherein:

the first heating has a peak temperature between 800 F and 1100 F; and the second heating has a peak temperature in excess of 1500 F.

20. The method of claim 15 wherein:

the first heating has a temperature between 800 F and 1100 F for at least 2.0 hours; and the second heating has a temperature in excess of 1500 F for at least 1.0 hour.

21. The method of claim 15 wherein the second portion comprises:

said refractory metal core;

a coating on said refractory metal core; and a ceramic core secured to said refractory metal core prior to the applying.

22. A method for forming an investment casting mold comprising:

applying one or more coating layers to a sacrificial pattern having a first portion for forming a mold void and a second portion for forming a portion of the mold;

a first step for removing a major portion of the pattern first portion and leaving the second portion within a shell formed by the coating layers;

a second step for initial hardening of the shell effective to provide the shell with a first modulus of rupture (MOR) strength no more than 85% of a maximum MOR strength; and a third step for further hardening of the shell without substantial degradation of the pattern second portion.

23. The method of claim 22 used to fabricate a gas turbine engine component.

24. The method of claim 22 wherein:

the second step is essentially performed under an oxygen partial pressure of at least twenty kPa, the third step is essentially performed under an oxygen partial pressure of no more than five kPa.

25. A method for investment casting comprising:

forming an investment casting mold as in claim 22;

introducing molten metal to the mold;

permitting the molten metal to solidify; and destructively removing the investment casting mold.

* * * * *